US007017754B2

(12) United States Patent
Sato et al.

(10) Patent No.: US 7,017,754 B2
(45) Date of Patent: Mar. 28, 2006

(54) METHOD AND APPARATUS FOR CLASSIFYING FINE BALLS AND METHOD FOR PRODUCING CYLINDRICAL SIEVE

(75) Inventors: Koji Sato, Shimane-ken (JP); Takeshi Kuboi, Shimane-ken (JP); Masashi Onomura, Yamaguchi-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 207 days.

(21) Appl. No.: 10/300,756

(22) Filed: Nov. 21, 2002

(65) Prior Publication Data

US 2004/0099577 A1 May 27, 2004

(51) Int. Cl.
*B07B 1/22* (2006.01)

(52) U.S. Cl. ..... 209/397; 209/284

(58) Field of Classification Search ..... 209/284, 209/285, 286, 288, 294, 397, 664, 931
See application file for complete search history.

(56) References Cited

U.S. PATENT DOCUMENTS 2,646,805 A * 7/1953 Anderson ..... 453/8
3,018,891 A * 1/1962 Bergstrom ..... 209/397
3,121,660 A * 2/1964 Hall, Jr. ..... 162/348
5,021,150 A * 6/1991 Burklin ..... 209/245
5,593,043 A * 1/1997 Ozmerih ..... 209/303
6,179,703 B1 * 1/2001 Knutsson et al. ..... 453/3

FOREIGN PATENT DOCUMENTS

JP 56073559 A * 6/1981
JP 57013029 A * 1/1982
JP 06-254497 9/1994
JP 2002-505954 2/2002

* cited by examiner

*Primary Examiner*—Donald P. Walsh
*Assistant Examiner*—Joseph Rodriguez
(74) *Attorney, Agent, or Firm*—Sughrue Mion, PLLC

(57) ABSTRACT

An apparatus for classifying fine balls having diameters of 1 mm or less into those having predetermined diameter ranges, comprising a feeder for supplying fine balls, at least one rotatable cylindrical sieve constituted by a plate with a thickness of 200 μm or less having circular holes and having a center axis inclined relative to a horizontal plane, and a container for receiving fine balls classified by subjecting the fine balls to falling from the cylindrical sieve, the fine balls being supplied from the feeder to an inlet of the rotating cylindrical sieve at its upper end, fine balls that have passed through the circular holes of the cylindrical sieve being subjected to falling to be recovered by the container, and fine balls that have not passed through the circular holes being withdrawn from an exit of the cylindrical sieve at its lower end.

14 Claims, 5 Drawing Sheets

METHOD AND APPARATUS FOR CLASSIFYING FINE BALLS AND METHOD FOR PRODUCING CYLINDRICAL SIEVE

FIELD OF THE INVENTION

The present invention relates to a method and an apparatus for classifying fine balls having diameters of 1 mm or less, and a method for producing a cylindrical sieve for classifying such fine balls.

BACKGROUND OF INVENTION

Fine balls having diameters of about 1 mm or less, high sphericity, and an extremely sharp diameter distribution, such as bearing balls, solder balls for connecting IC packages, etc., are precisely classified into the predetermined diameter ranges. To obtain fine balls in the targeted diameter range, it is necessary to conduct a classification for removing fine balls having larger diameters than the upper limit, and a classification for removing fine balls having smaller diameters than the lower limit.

In the classification for removing fine balls having larger diameters than the upper limit, the fine balls that have passed through sieve holes (hereinafter referred to as "passing-through balls") are determined as passed products, and those that have not passed through sieve holes (hereinafter referred to as "residual balls") are determined as failed products. On the other hand, in the classification for removing fine balls having smaller diameters than the lower limit, the residual balls are determined as passed products, and the passing-through balls are determined as failed products.

Conventionally used as means for classifying fine balls having high sphericity and an extremely sharp diameter distribution are sonic sieves using electroformed flat sieves having holes with precisely controlled inner diameters, which are produced by electroforming methods (JP 2002-505954 A). Such a sonic sieve is generally a flat sieve having holes, on which fine balls are vibrated by sound waves so that they fall through the holes efficiently. In the classification for removing fine balls having larger diameters than the upper limit, only small numbers of failed products remain as residual balls on the sieve, while almost all fine balls pass through the holes. Accordingly, the classification is easy even with such sonic sieves.

However, in the classification for removing fine balls having smaller diameters than the lower limit, there is a problem that because there are a large percentage of the residual balls, they clog the holes of the sonic sieve. As a result, there is a high probability that the failed products, which should be passing-through balls, are mixed into the residual balls and thus determined as the passed products. Therefore, in the classification of the residual balls as the passed products by the sonic sieve using an electroformed flat sieve, it is necessary that the number of fine balls supplied onto the electroformed sieve should be reduced, and that a classification operation should be carried out for a long period of time.

However, the classification for a long period of time (long residual time of fine balls) leads to damage on the fine balls and the electroformed sieve. This problem is serious particularly when the fine balls are continuously supplied for high efficiency.

Also known is a roller classification machine for carrying out the classification of fine balls by rolling the fine balls between two rollers with a precisely controlled gap.

However, in the case of the roller classification machine, only one layer of fine balls can be supplied between the rollers, resulting in low classification capacity and thus unsuitable for mass classification.

OBJECT OF THE INVENTION

Accordingly, an object of the present invention is to provide a method and an apparatus for surely carrying out a classification treatment for removing fine balls having diameters outside the upper and lower limits from those having diameters of 1 mm or less in a short period of time, and a method for producing a cylindrical sieve for the classification of such fine balls.

DISCLOSURE OF THE INVENTION

As a result of intensive research in view of the above object, the inventors have found that by forming a plate having circular holes into a cylindrical sieve, and by rotating the cylindrical sieve around its center axis with fine balls contained in the cylindrical sieve, it is possible to remove-fine balls having diameters outside the upper and lower limits efficiency so as to obtain fine balls having predetermined diameter ranges. The present invention has been completed based on this finding.

Thus, the method for classifying fine balls having diameters of 1 mm or less into those having predetermined diameter ranges according to the present invention comprises introducing fine balls to the inside of a cylindrical sieve constituted by a plate with a thickness of 200 μm, or less having circular holes to subject them to falling through the circular holes while rotating the cylindrical sieve, thereby classifying the fine balls.

The apparatus for classifying fine balls having diameters of 1 mm or less into those having predetermined diameter ranges according to the present invention comprises a feeder for supplying fine balls, at least one rotatable cylindrical sieve constituted by a plate with a thickness of 200 μm or less having circular holes, and a container for receiving fine balls classified by subjecting the fine balls to falling from the cylindrical sieve, the fine balls being supplied from the feeder to an inlet of the rotating cylindrical sieve at its upper end, fine balls that have passed through the circular holes of the cylindrical sieve being subjected to falling to be recovered by the container, and fine balls that have not passed through the circular holes being withdrawn from an exit of the cylindrical sieve at its lower end.

The method for producing a cylindrical sieve used for classifying fine balls having diameters of 1 mm or less according to the present invention comprises the steps of punching a plate having a thickness of 30–200 μm by 100 sets or less of pins and dies, to form circular holes having inner diameters corresponding to the upper or lower limit of diameters of fine balls to be removed at an interval of 80–200 μm, and working the plate provided with circular holes to a cylindrical body having a diameter of 50–200 μm.

The circular holes of the plate of the cylindrical sieve are preferably formed by punching. The cylindrical sieve preferably has 100,000 circular holes or more. The cylindrical sieve is preferably constituted by a ferritic stainless steel sheet, or a resin sheet having a surface resistivity of $1\times10^{13}$ Ω or less. It is preferable that the plate has a thickness of 30–200 μm, and that the interval of the circular holes is 80–200 μm.

The above apparatus for classifying fine balls preferably comprises a cylindrical sieve having a center axis inclined relative to a horizontal plane, a feeder for quantitatively supplying fine balls to an inlet of the cylindrical sieve at its upper end, and an outlet provided at a lower end of the cylindrical sieve for withdrawing fine balls that have not passed through the circular holes.

In the method and apparatus mentioned above, the standard deviation $\alpha$ of the inner diameter distribution of the cylindrical sieve formed with the circular holes is 0.35 μm or less.

DESCRIPTION OF THE PREFERRED EMBODIMENT

Figure 1:
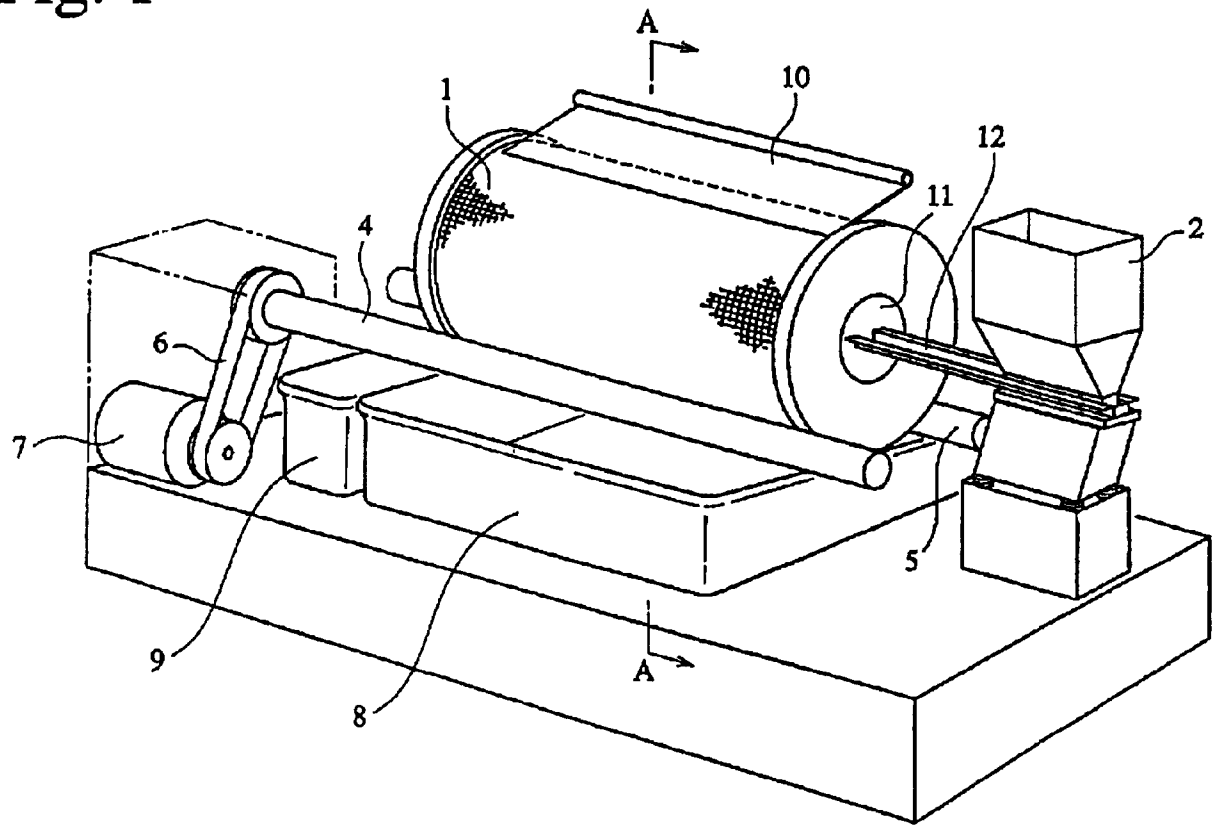
FIG. 1 is a perspective view showing one example of apparatuses for classifying fine balls.

The first feature of the present invention is to use a cylindrical sieve constituted by a plate having circular holes. The second feature of the present invention is to form the circular holes by punching. When fine balls having diameters of 1 mm or less are introduced into a rotating cylindrical sieve with these features, there are increased chances that the fine balls face the circular holes of the cylindrical sieve, resulting in the classification of fine balls with improved efficiency and high precision.

The plate having circular holes may be an electroformed sieve, which is a metal plate having circular holes formed by electroforming a metal on a non-conductive substrate having an electrically conductive portion in a desired sieve pattern, a plate having circular holes formed by etching or punching, etc. Among them, a plate having circular holes, particularly a plate having punched circular holes, is preferable from the viewpoint of classification efficiency. The electroformed sieve is also preferable because it is free from clogging because of tapered edges of its holes. A cylindrical sieve constituted by a plate having circular holes has smaller surface roughness in a portion other than the holes of a cylindrical sieve constituted by a wire net. To classify fine balls having diameters of 1 mm or less into those having predetermined diameter ranges efficiently, it is important to rotate and move the fine balls smoothly with the jumping of the fine balls suppressed on a sieve surface. When the plate having punched holes is used as a sieve plate with small surface roughness, there are increased chances that the fine balls face the circular holes, resulting in improvement in classification efficiency.

In the classification treatment for removing fine balls having smaller diameters than the lower limit by a conventional sonic sieve comprising an electroformed flat sieve, a large amount of residual balls remaining on the sieve restrict the chances that the fine balls face the circular holes of the sieve, so that fine balls having such sizes that they should be passing-through balls are often determined as the residual balls. On the other hand, when fine balls are rotated and moved in a circumferentially rotating cylindrical sieve constituted by a plate having circular holes, the chances of the fine balls facing the circular holes of the cylindrical sieve are much higher than in the case of the classification using the electroformed flat sieve, resulting in higher classification efficiency.

Also, when a cylindrical sieve constituted by a plate having punched holes is used, high classification precision can be obtained for the reasons set forth below. In the case of the classification using a sieve, the inner diameter distribution of the sieve on the side of larger diameters than the targeted inner diameter generally has large influence on classification precision, while the side of smaller diameters than the targeted inner diameter has influence only on classification efficiency.

Specifically, for instance, in the case of the classification for removing fine balls having smaller diameters than the lower limit as passing-through balls, fine balls having such diameters that they should be residual balls would become passing-through balls if the sieve had larger holes than the lower limit, failing to achieve high-precision classification. On the other hand, if the sieve had smaller holes than the lower limit, fine balls that should be passing-through balls would act as residual balls on such holes. However, because such residual balls face other holes having larger inner diameters than the lower limit, they would finally become passing-through balls. Thus, the existence of smaller holes than the lower limit of the targeted diameter is a cause of decrease in classification efficiency, but it is not a cause of decrease in classification precision. This is true in the classification for removing fine balls having larger diameters than the upper limit as residual balls.

The improvement of the classification efficiency can be achieved by using a cylindrical sieve, and further by making the cylindrical sieve larger. To improve the classification precision, however, the inner diameter distribution of the cylindrical sieve on the side of larger diameters than the targeted inner diameter should be decreased. Namely, on the side of larger diameters than the targeted inner diameter, (a) the expansion of the inner diameter distribution should be decreased, and (b) the frequency (percentage) of inner diameters should be reduced. For this purpose, a so-called punched sieve, which has circular holes provided by punching, is used. This reason is that the punched sieve is narrower than the electroformed sieve in an inner diameter distribution particularly on the side of larger diameters than the targeted inner diameter.

The standard deviation $\sigma$ of the inner diameter distribution of a sieve formed with circular holes having inner diameters of 1 mm or less is about 0.5 μm for the electroformed sieve and 0.35 μm or less for the punched sieve, and the standard deviation $\sigma$ of the inner diameter distribution of the punched sieve may further be 0.15 μm or less. Particularly the inner diameter distribution of circular holes on the side of larger diameters than the targeted inner diameter can be narrower in the punched sieve than the electroformed sieve, which is important to improve classification precision. The reason why the inner diameter distribution can be reduced on the side of larger diameters than the targeted inner diameter in the punched sieve is that circular holes having larger diameters than those of pins used for punching are not formed in the punched sieve.

Because the inner diameter distribution on the side of larger diameters than the targeted inner diameter can be reduced in the punched sieve, the classification precision of fine balls can be improved. To reduce the inner diameter distribution of punched holes, it is preferable to punch all holes by a set of a pin and a die. The use of a set of a pin and a die is easier than the use of plural sets of pins and dies in making the inner diameter distribution narrower.

Many sieves used for the classification of fine balls have more than 100,000 circular holes to have increased classification efficiency. When a large number of circular holes are formed in a sieve plate, the punching of all holes by a set of a pin and a die is too low in production efficiency, resulting in increase in classification cost. Accordingly, taking into consideration a balance of an inner diameter distribution and production efficiency for a sieve, it is preferable to punch all holes by 100 sets or less of pins and dies.

When a sieve plate is too thick relative to the inner diameters of circular holes, clogging is caused during classification. Accordingly, the sieve plate is preferably as thin as possible in a range causing no damage to the strength of the sieve plate. However, it is difficult to make an electroformed sieve made of nickel or a nickel-cobalt alloy thin, from the viewpoint of strength. It is also difficult to form an electroformed sieve from multi-element alloys such as stainless steel, etc. Further, columnar crystals having small strength in crystal grain boundaries grow in parallel with the hole axes of the plate during the production of the electroformed sieve. Accordingly, the columnar crystals on the holes edges are likely to be broken in the crystal grain boundaries by classification for a long period of time, resulting in decrease in classification precision.

On the other hand, there is little restriction in plate materials in the sieve having punched holes, making it possible to use a high-strength sheet such as a rolled sheet, etc. Accordingly, the sieve having punched holes can be made thinner than the electroformed sieve. Specifically, the punched sieve has a thickness of preferably 30–200 μm, more preferably 30–100 μm. When the thickness of the punched sieve is less than 30 μm, the resultant cylindrical sieve has insufficient rigidity. On the other hand, when the thickness of the punched sieve exceeds 200 μm, clogging becomes likely, resulting in decrease in classification efficiency. The thickness of the punched sieve is preferably determined in this range depending on the diameters of fine balls to be classified.

The interval of holes formed in the plate, which is the shortest distance between adjacent circular holes, is preferably 80–200 μm. To increase the number of circular holes per a unit area to increase classification efficiency, the interval of circular holes is preferably 200 μm or less. However, when the interval of circular holes is too narrow, the sieve has insufficient strength. Therefore, the interval of circular holes is preferably 80 μm or more.

For the above reasons, the cylindrical sieve used for the apparatus of the present invention for classifying fine balls is formed by punching a plate having a thickness of 30–200 μm by 100 sets or less of pins and dies, to provide the plate with 100,000 or more of circular holes each having a diameter of 1 mm or less at an interval of 80–200 μm, and forming the resultant punched plate into a cylindrical body having a diameter of 50–200 mm.

When the diameter of the cylindrical sieve is less than 50 mm, the cylindrical sieve has too small a radius of curvature, resulting in large deformation of holes. The shape of the circular holes affects the classification precision. Accordingly, when the plate is formed into a cylindrical sieve having a diameter of less than 50 mm, punching should be carried out taking into consideration the extent of deformation of circular holes, so that it is difficult to achieve high precision in hole shapes stably. Also, when the radius of curvature is too small, each fine ball is brought into contact with the sieve with a small area, resulting in low classification efficiency.

On the other hand, the cylindrical sieve having a diameter of more than 200 mm needs too large a plate, so that the punching pins for forming circular holes are worn. As a result, it is difficult to form stably at a low cost such high-precision holes that the standard deviation σ of their inner diameter distribution is 0.25 μm or less. Therefore, the diameter of the cylindrical sieve is preferably 50–200 mm.

A material for the punched sieve is preferably ferritic stainless steel to obtain a high-precision inner diameter. The ferritic stainless steel is electrically conductive and free from the problem that dust, etc. are attracted thereto by static electricity. Also, because the ferritic stainless steel is resistant to rusting, rust is not mixed into fine balls, and thus the inner diameter of the sieve is not changed by rust.

Further, ferritic stainless steel is more suitable for punching than other stainless steel in mechanical properties such as toughness and hardness. Namely, because ferritic stainless steel has lower ductility than austenitic stainless steel, burrs are less likely to be generated in the punching of ferritic stainless steel, thereby making it possible to punch holes with high precision. While martensitic stainless steel has too high hardness, ferritic stainless steel has suitable hardness. Therefore, the ferritic stainless steel avoids the damage of a die used for working, thereby suppressing decrease in the precision of the inner diameters of holes and reducing production cost. Particularly preferable is ferritic stainless steel with little carbides, nitrides, intermetallic compounds and other inclusions of 10 μm or more. This is because the existence of carbides, etc. on the opening edges of holes cause cracking in the edges, resulting in decrease in the precision of the inner diameters.

When fine balls made of soft materials such as Sn alloys, etc. and having hardness of about 10–20 Hv are classified, the punched sieve is preferably constituted by a resin sheet. Because the resin sheet is extremely soft, fine balls are not damaged by the opening edges of holes. However, when a usual resin is used, fine balls rotating in the sieve generate static electricity, and fine balls attached to the sieve prevent classification. Therefore, it is preferable to use a sheet made of a resin containing an antistatic agent, specifically a resin sheet having a surface resistivity of $1\times10^{13}$ Ω or less. To achieve the surface resistivity of $1\times10^{13}$ Ω or less for an antistatic effect, for instance, resins such as polystyrene, etc. may be blended with electrically conductive additives such as carbon black, etc. An acrylonitrile-butadiene-styrene copolymer (ABS) containing titanium oxide is also preferable because of an antistatic function.

Figure 2:
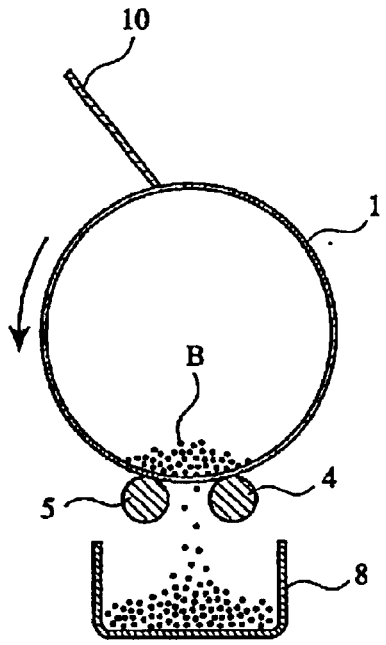
FIG. 2 is a cross-sectional view taken along the line A—A in FIG. 1.
Figure 3:
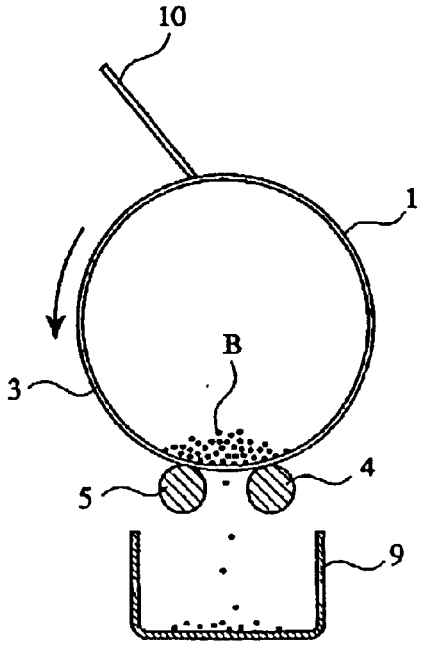
FIG. 3 is a partially cross-sectional left side view showing the classification apparatus of FIG. 1.

One example of classification apparatuses used for the above cylindrical sieve is shown in FIGS. 1–3. This apparatus for classifying fine balls comprises a circumferentially rotatable cylindrical sieve 1 having a center axis inclined relative to a horizontal plane, a feeder 2 disposed near an inlet 11 of the cylindrical sieve 1 at its one end on an upper side of the inclined center axis, an outlet 3 of the cylindrical sieve 1 for discharging residual balls at its other end on a lower side of the inclined center axis, a pair of rollers 4, 5 in contact with an outer surface of the cylindrical sieve 1 for rotating it, a motor 7 for rotating one roller 4 via a driving belt 6, a container 8 disposed under the cylindrical sieve 1 for receiving passing-through balls, and a container 9 disposed under the outlet 3 for receiving the residual balls. As shown in FIG. 3, the outlet 3 may be an open end of the cylindrical sieve 1. The residual balls gradually moving down toward the outlet 3 in the cylindrical sieve 1 fall from the outlet 3 to the container 9. A scraper 10 for removing clogging balls is disposed on an upper side of the cylindrical sieve 1. A duct 12 for supplying fine balls to the cylindrical sieve 1 is disposed between the feeder 2 and the inlet 11.

Figure 4:
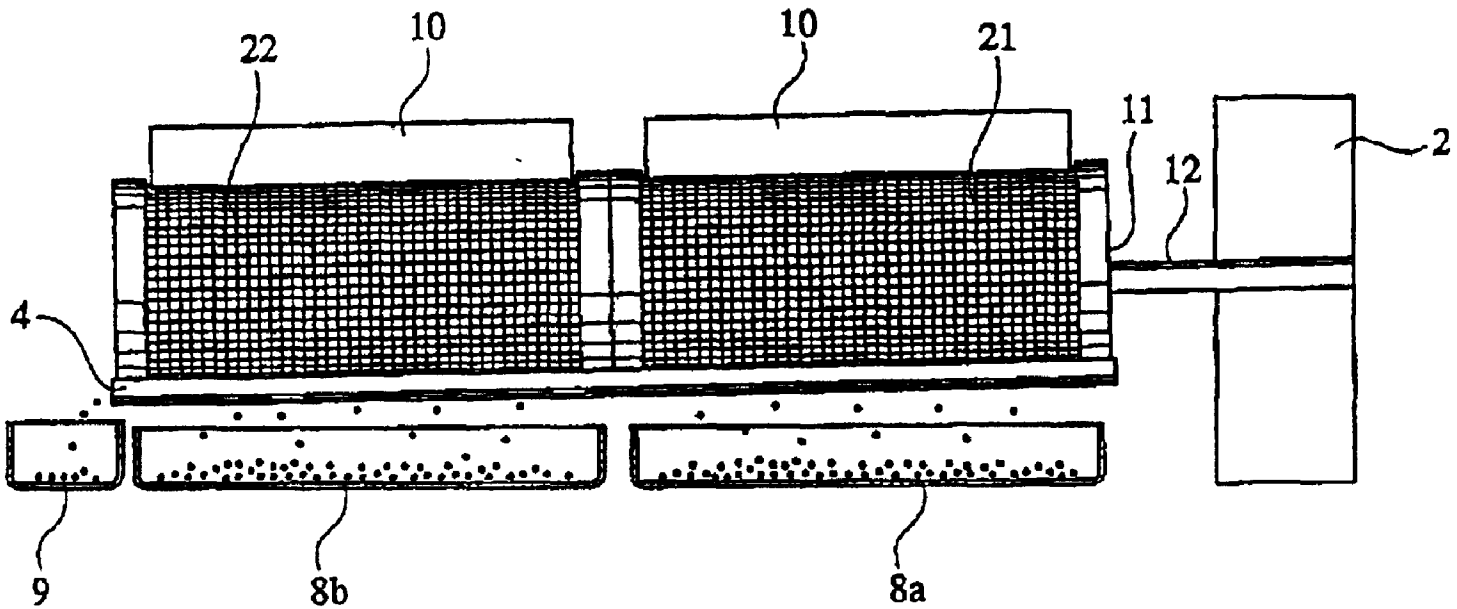
FIG. 4 is a cross-sectional view showing another example of apparatuses for classifying fine balls.

FIG. 4 shows another example of the apparatuses for classifying fine balls. The same reference numerals are assigned to the same parts as in FIG. 1. This apparatus for classifying fine balls is characterized by comprising a cylindrical sieve 21 for removing fine balls having smaller diameters than the lower limit, and a cylindrical sieve 22 for removing fine balls having larger diameters than the upper limit. A container 8*a* for receiving fine balls having smaller diameters than the lower limit is disposed under the cylindrical sieve 21, and a container 8*b* for receiving fine balls having diameters equal to or smaller than the upper limit is disposed under the cylindrical sieve 22. With respect to other parts than these parts, this apparatus is substantially the same as the apparatus of FIG. 1 for classifying fine balls.

When the classification of fine balls is carried out by using the apparatus for classifying fine balls shown in FIGS. 1–3, the fine balls B are supplied from the feeder 2 to the circumferentially rotating cylindrical sieve 1. The fine balls B having smaller diameters than the inner diameters of the holes of the cylindrical sieve 1 pass through the circular holes of the cylindrical sieve 1 and are recovered as passing-through balls by the container 8 below. On the other hand, the fine balls B having larger diameters than the inner diameters of the circular holes of the cylindrical sieve 1 gradually move downward (toward the outlet 3) in the cylindrical sieve 1 as residual balls without passing through the circular holes, and finally discharged from the outlet 3 successively. The residual time of the fine balls B in the cylindrical sieve 1 can properly be set depending on the supply speed of the fine balls B, the size of the cylindrical sieve 1, the inclination angle of the center axis of the cylindrical sieve 1, the rotation speed of the cylindrical sieve 1, etc. Thus, the apparatus of the present invention can carry out the continuous classification treatment of fine balls.

In the case of classifying fine balls having diameters of 0.01–1 mm, the peripheral speed of the circumferentially rotating cylindrical sieve 1 is preferably 5–250 mm/second. When the peripheral speed of the cylindrical sieve 1 is less than 5 mm/second, a sufficient classification treatment speed cannot be obtained, though it is more efficient than a flat plate sieve. On the other hand, when the peripheral speed exceeds 250 mm/second, the fine balls rotate too fast, resulting in a rather decreased probability that the fine balls pass through the circular holes, and thus decreased classification efficiency.

The fine balls having diameters equal to or slightly larger than the inner diameters of the circular holes are likely to be fitted into the circular holes, resulting in clogging the holes. If such clogging of the holes occurred, the number of circular holes effective for classification would decrease, resulting in decrease in classification efficiency. Accordingly, it is necessary to remove the clogging balls by a blasted gas or a mechanical means.

Tapping balls are used in conventional sonic flat sieves to remove clogging fine balls therefrom mechanically. However, particularly in the case of the classification of a large number of fine balls having relatively uniform diameters, clogging occurs extremely often, so that it is difficult to remove the clogging balls sufficiently by the tapping balls.

Therefore, the classification apparatus comprising the cylindrical sieve of the present invention preferably comprises a scraper 10 on an upper side of the cylindrical sieve 1 as shown in FIG. 1, which removes the clogging balls from the cylindrical sieve 1 utilizing its rotation force.

The present invention will be explained in more detail referring to Examples below, without intention of restricting the present invention thereto.

EXAMPLES 1–3

Comparative Example 1

Figure 5:
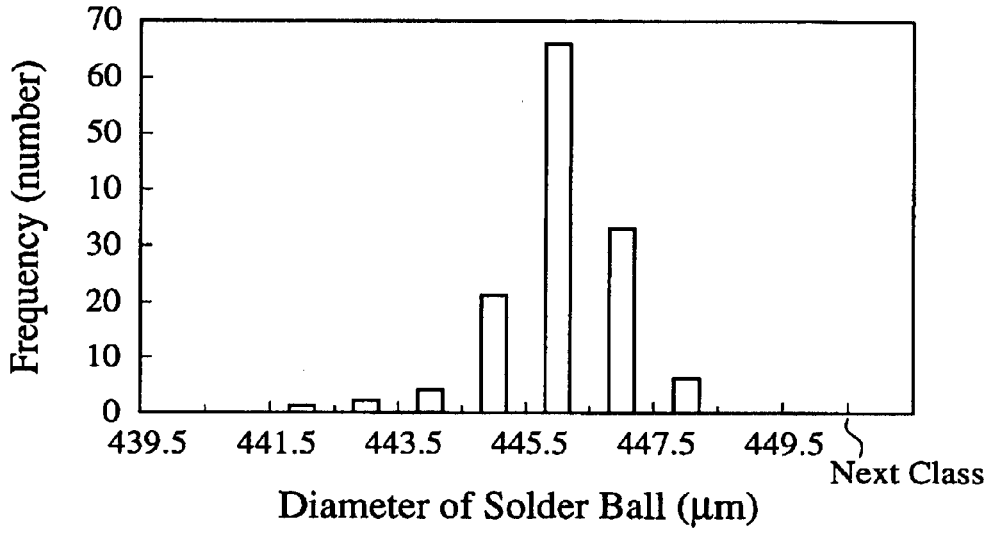
FIG. 5 is a histogram showing the diameter distribution of solder balls before classification.

Using the classification apparatus shown in FIGS. 1–3 and a sonic sieve, about 200,000 solder balls of Sn-2.9Ag-0.5Cu (% by mass) were subjected to a classification treatment to remove solder balls having diameters less than 444.0 μm. FIG. 5 shows the histogram of the diameter distribution of solder balls before classification. The solder balls before classification had an average diameter of 445.5 μm, and the standard deviation indicating their diameter distribution was 1.03. The specification of the apparatus and classification conditions in each of Examples and Comparative Example are as shown below.

Example 1

Classification means: classification apparatus shown in FIGS. 1–3,
Sieve: punched sieve (material: SUS 430),
Average inner diameter of holes: 444.0 μm,
Standard deviation of diameter distribution of holes: 0.16 um,
Number of holes: 300,000,
Interval of holes: 100 μm,
Size of sieve plate: width 143 mm×length 320 mm×thickness 70 μm,
Diameter of cylindrical sieve: 100 mm (plate ends slightly overlapped),
Residual time of solder balls: 60 seconds, and
Peripheral speed of cylindrical sieve: 80 mm/second.

Example 2

Classification means: classification apparatus shown in FIGS. 1–3,
Sieve: punched sieve (material: resin[(1)]),
Note: (1) Blend of 90% by mass of ABS resin and 10% by mass of carbon black having a surface resistivity of $2\times10^{12}$ Ω.
Average inner diameter of holes: 444.0 μm,
Standard deviation of diameter distribution of holes: 0.24 μm,
Number of holes: 300,000,
Interval of holes: 100 μm,
Size of sieve plate: width 143 mm×length 320 mm×thickness 70 μm,
Diameter of cylindrical sieve: 100 mm (plate ends slightly overlapped),
Residual time of solder balls: 60 seconds, and
Peripheral speed of cylindrical sieve: 80 mm/second.

Example 3

Classification means: classification apparatus shown in FIGS. 1–3,
Sieve: electroformed sieve (material: Ni), Average inner diameter of holes: 443.9 μm,
Standard deviation of diameter distribution of holes: 0.50 μm,
Number of holes: 300,000,
Interval of holes: 100 μm,
Size of sieve plate: width 143 mm×length 320 mm×thickness 70 μm,
Diameter of cylindrical sieve: 100 mm (plate ends slightly overlapped),
Residual time of solder balls: 60 seconds, and
Peripheral speed of cylindrical sieve: 80 mm/second.

Comparative Example 1

Classification means: sonic sieve(2)
Note: (2) "Sonic Shifter P60®" available from Seishin Enterprise Co., Ltd.
Sieve: electroformed sieve (material: Ni),
Average inner diameter of holes: 443.9 μm,
Standard deviation of diameter distribution of holes: 0.50 μm,
Number of holes: 300,000,
Interval of holes: 100 μm,
Size of sieve plate: width 143 mm×length 320 mm×thickness 70 μm,
Diameter of cylindrical sieve: 100 mm (plate ends slightly overlapped),
Residual time of solder balls: 60 seconds, and
Peripheral speed of cylindrical sieve: 80 mm/second.

Figure 6:
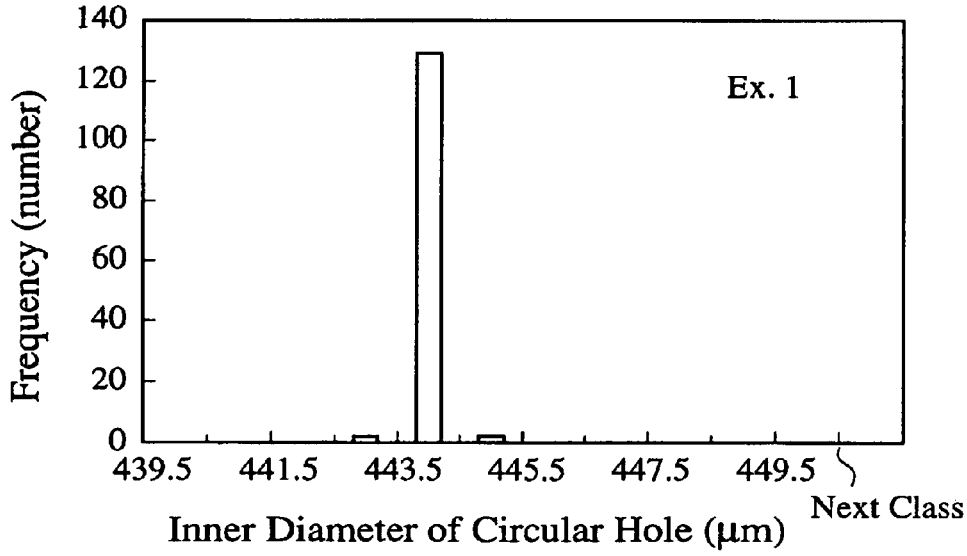
FIG. 6 is a histogram showing the inner diameter distribution of circular holes of a punched sieve made of SUS 430 in Example 1.
Figure 7:
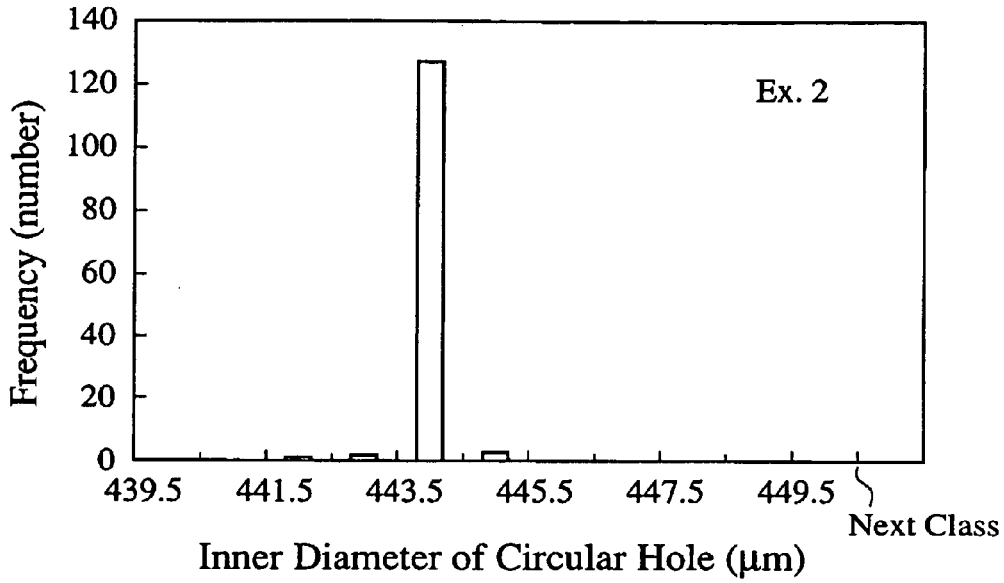
FIG. 7 is a histogram showing the inner diameter distribution of circular holes of a punched sieve made of a resin in Example 2.
Figure 8:
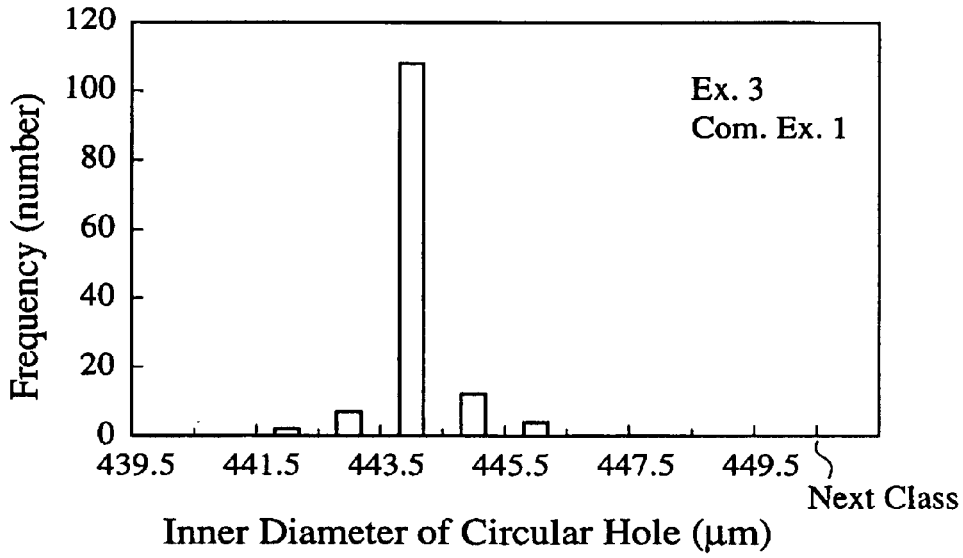
FIG. 8 is a histogram showing the inner diameter distribution of circular holes of an electroformed sieve made of Ni in Example 3 and Comparative Example 1.

FIGS. 6–8 show the inner diameter distributions of circular holes of sieves used in Examples 1–3 and Comparative Example 1, respectively. It has been found that the punched sieves are narrower than the electroformed sieves in an inner diameter distribution, and that the former is smaller than the latter particularly in an inner diameter distribution on the side of larger diameters than the targeted value (444.0 μm).

The percentage and maximum diameter of passing-through balls were measured by a classification treatment of solder balls for 60 seconds, to evaluate classification efficiency and classification precision. The results are shown in Table 1. Assuming that the diameter distribution of solder balls is a normal distribution, and that only solder balls of less than 444.0 μm were completely removed, the theoretical percentage of passing-through balls is about 7%.

TABLE 1

| No. | Example 1 | Example 2 | Example 3 | Comparative Example 1 |
|---|---|---|---|---|
| Classification Apparatus | Cylindrical Sieve | | | Sonic Sieve |
| Sieve | Punched Sieve (SUS 430) | Punched Sieve (Resin) | Electroformed Sieve (Ni) | Electroformed Sieve (Ni) |
| Percentage of Passing-through balls | 21% | 31% | 68% | 1 |
| Maximum Diameter of Passing-through balls | 444.9 μm | 445.3 μm | 446.3 μm | 443.1 μm |

The average diameter and maximum diameter of solder balls were measured by the following method. 133 solder balls were successively irradiated with parallel light, and the projected image of each solder ball was taken by a CCD camera to calculate a diameter of a corresponding circle assuming the projected image as a true circle, and the diameter of a corresponding circle was regarded as a diameter of each solder ball. The average diameter is an averaged value of the diameters of 133 solder balls, and the maximum diameter is the maximum of the diameters of 133 solder balls. The average inner diameter of circular holes of the sieve is also an averaged value of the inner diameters determined by image processing from the projected images of 133 circular holes measured by parallel light according to the same method as above.

As shown in Table 1, in Comparative Example 1 using the flat sonic sieve, the percentage of passing-through balls was 1%, extremely lower than the theoretical value, presumably because the holes of the sonic sieve were clogged with residual balls, so that many of the solder balls that should be passing-through balls were not removed. This proves that a classification method using a sonic sieve constituted by a flat plate fails to conduct precise classification with the targeted diameter as a dividing line.

On the other hand, in Examples 1–3 each using a cylindrical sieve, the percentage of passing-through balls was as high as 21% or more in the same period of time for classification as in Comparative Example 1. This is because clogging is extremely more unlikely to occur in the cylindrical sieve than in the flat sieve whose entire surface is always used for classification. Therefore, the cylindrical sieve provides higher classification efficiency.

In Example 1 using a punched sieve made of SUS 430, Example 2 using a punched resin sieve, and Example 3 using an electroformed Ni sieve, the percentages of passing-through balls as a measure of classification precision were 21%, 31% and 68%, respectively, higher than the theoretical value (7%). Because an excess part than the theoretical value may be regarded as the percentage of solder balls that should be residual balls, the smaller this excess percentage, the higher the classification precision. The same classification efficiency was obtained in Examples 1–3 each using a sieve with the same area ratio of circular holes. It is thus clear from the percentage of passing-through balls exceeding the theoretical value that Example 1 using a punched sieve made of SUS 430 was best, and Example 2 using a punched resin sieve was second best in classification precision.

With respect to the maximum diameter of passing-through balls, Examples 1 and 2 each using a punched sieve were smaller than Example 3 using an electroformed sieve, and the maximum diameter was close to 444.0 μm, the targeted lower limit, in Examples 1 and 2. These results also indicate that the punched sieve provides higher classification precision. Incidentally, in Example 2, the adhesion of solder balls to the resin sieve due to electric charging of the sieve during the classification was not observed.

As described above in detail, because the present invention drastically improves efficiency and precision in the classification of fine balls having diameters of 1 mm or less, it is suitable for the classification treatment of fine balls whose diameters should be controlled strictly in their upper and lower limits.

What is claimed is:

1. An apparatus for classifying fine balls having diameters of 1 mm or less into those having predetermined diameter ranges, comprising a feeder for supplying fine balls, at least one rotatable cylindrical sieve constituted by a plate with a thickness of 200 μm or less having circular holes, said rotatable cylindrical sieve having a center axis inclined relative to a horizontal plane, and a container for receiving fine passing-through balls classified by subjecting said fine balls to falling from said cylindrical sieve, said fine balls being supplied from said feeder to an inlet of said rotating cylindrical sieve at its upper end, fine passing-through balls that have passed through the circular holes of said cylindrical sieve being subjected to falling to be recovered by said container, and fine residual balls that have not passed through said circular holes being withdrawn from an exit of said cylindrical sieve at its lower end, wherein the standard deviation σ of the inner diameter distribution of said cylindrical sieve formed with said circular holes is 0.35 μm or less.

2. The apparatus for classifying fine balls according to claim 1, wherein the circular holes of said plate are formed by punching, whereby fine balls having diameters of 1 mm or less rotate and move smoothly with jumping of said fine balls suppressed on a sieve surface to cause increased chances that the fine balls face the holes, resulting in improvement in classification efficiency.

3. The apparatus for classifying fine balls according to claim 1, wherein said cylindrical sieve has 100,000 holes or more of circular holes.

4. The apparatus for classifying fine balls according to claim 1, wherein a thickness of said plate is 30–200 μm, and an interval of said circular holes is 80–200 μm.

5. The apparatus for classifying fine balls according to claim 1, wherein said cylindrical sieve is constituted by a ferritic stainless steel sheet.

6. The apparatus for classifying fine balls according to claim 1, wherein said cylindrical sieve is constituted by a resin sheet having a surface resistivity of $1\times10^{13}$ Ω or less.

7. The apparatus for classifying fine balls according to claim 1, wherein said rotatable cylindrical sieve is a circumferentially rotating cylindrical sieve.

8. The apparatus for classifying fine balls according to claim 7, wherein said circumferentially rotating cylindrical sieve has a diameter of 50–200 mm.

9. The apparatus for classifying fine balls according to claim 8, wherein the standard deviation σ of the inner diameter distribution of said cylindrical sieve formed with said circular holes is 0.15 μm or less.

10. The apparatus for classifying fine balls according to claim 7, wherein the standard deviation σ of the inner diameter distribution of said cylindrical sieve formed with said circular holes is 0.15 μm or less.

11. The apparatus for classifying fine balls according to claim 1, wherein said punched plate has a thickness of 30–200 μm, interval of the holes is 80–200 μm with 100,000 holes or more circular holes each having diameters of 1 mm or less at an interval of 80–200 μm where the cylindrical body has a diameter of 50–200 mm.

12. The apparatus for classifying fine balls according to claim 11, wherein the standard deviation σ of the inner diameter distribution of said cylindrical sieve formed with said circular holes is 0.15 μm or less.

13. The apparatus for classifying fine balls according to claim 1, wherein the standard deviation σ of the inner diameter distribution of said cylindrical sieve formed with said circular holes is 0.15 μm or less.

14. The apparatus for classifying fine balls according to claim 1, wherein said the cylindrical sieve comprises a first cylindrical sieve for removing fine balls having smaller diameters than a lower limit and a second cylindrical sieve for removing fine balls having larger diameters than an upper limit.

* * * * *